US010938126B2

(12) United States Patent
Niu

(10) Patent No.: US 10,938,126 B2
(45) Date of Patent: Mar. 2, 2021

(54) WIRE CONNECTOR

(71) Applicant: KATERRA LIGHT (SHANGHAI) CO., LTD., Shanghai (CN)

(72) Inventor: Junjie Niu, Shanghai (CN)

(73) Assignee: KATERRA LIGHT (SHANGHAI) CO., LTD, Shanghai (CN)

( * ) Notice: Subject to any disclaimer, the term of this patent is extended or adjusted under 35 U.S.C. 154(b) by 0 days.

(21) Appl. No.: 16/813,545

(22) Filed: Mar. 9, 2020

(65) Prior Publication Data

US 2020/0350703 A1 Nov. 5, 2020

(30) Foreign Application Priority Data

Apr. 30, 2019 (CN) ..... 201910365055.5

(51) Int. Cl.

| | |
|---|---|
| ***H01R 11/20*** | (2006.01) |
| ***H01R 4/2407*** | (2018.01) |
| ***H01R 4/48*** | (2006.01) |
| ***H01R 11/09*** | (2006.01) |

(52) U.S. Cl.

CPC ..... *H01R 4/2407* (2018.01); *H01R 4/48* (2013.01); *H01R 11/09* (2013.01)

(58) Field of Classification Search

CPC ..... H01R 4/2407; H01R 4/48; H01R 11/09; H01R 11/01; H01R 9/24; H01R 4/2406; F21V 23/06

USPC ..... 439/402, 403, 404

See application file for complete search history.

(56) References Cited

U.S. PATENT DOCUMENTS

| | | | | |
|---|---|---|---|---|
| 3,388,370 | A * | 6/1968 | Elm | H01R 4/70 439/402 |
| 3,804,971 | A * | 4/1974 | Bazille, Jr. | H01R 4/2433 174/88 R |
| 3,899,236 | A * | 8/1975 | Santos | H01R 4/2433 439/402 |
| 3,912,356 | A * | 10/1975 | Johansson | H01R 4/2454 439/400 |
| 4,954,098 | A * | 9/1990 | Hollingsworth | H01R 4/2433 439/404 |
| 5,147,217 | A * | 9/1992 | Neale, III | H01R 4/2433 439/403 |
| 5,567,173 | A * | 10/1996 | Franckx | H01R 4/2433 439/403 |
| 5,735,706 | A * | 4/1998 | Ito | H01R 4/2433 439/402 |

(Continued)

*Primary Examiner* — Abdullah A Riyami
*Assistant Examiner* — Nelson R. Burgos-Guntin
(74) *Attorney, Agent, or Firm* — Clement Cheng

(57) ABSTRACT

The invention relates to the technical field of manufacturing illumination equipments, and more particularly, to a wire connector for use in an illumination equipment. The wire connector comprises: a receiving part having a hollow structure, wherein input wires and output wires are arranged in the receiving part; two conductive tabs, through which the input wires are connected to the output wires, the two conductive tabs are used to electrically connect the input wires and the output wires; wherein the receiving part comprises at least one clamping groove; a covering part clamped in the at least one clamping groove of the receiving part for sealing the two conductive tabs in the receiving part; the receiving part is connected to the covering part by means of a flexible part.

10 Claims, 7 Drawing Sheets

(56) References Cited

U.S. PATENT DOCUMENTS 5,746,610 A * 5/1998 Shiu ..... H01R 4/646 439/402
6,139,352 A * 10/2000 Daoud ..... H01R 4/2433 439/404
7,195,513 B1 * 3/2007 Gherardini ..... F16L 3/1025 439/401
7,252,551 B2 * 8/2007 Ueno ..... H01R 4/2433 439/404
7,297,029 B2 * 11/2007 Ueno ..... H01R 9/226 439/404
7,448,900 B1 * 11/2008 Chen ..... H01R 4/2412 439/402
7,611,374 B1 * 11/2009 Chiu ..... H01R 4/2454 439/402
7,695,308 B2 * 4/2010 Allwood ..... H01R 4/2433 439/418
8,007,310 B2 * 8/2011 Landis ..... H01R 13/6273 439/404
8,246,361 B2 * 8/2012 Dennes ..... H01R 4/2433 439/107
8,444,431 B1 * 5/2013 La Salvia ..... H01R 4/2408 439/404
8,481,868 B2 * 7/2013 Dennes ..... H01R 4/2433 174/549
8,678,852 B2 * 3/2014 Rineau ..... H01R 4/44 439/402
9,887,469 B1 * 2/2018 King, Jr. ..... H01R 4/2454
2010/0155135 A1 * 6/2010 Yamamoto ..... B60Q 3/51 174/536
2012/0329309 A1 * 12/2012 Weaver ..... H01R 4/242 439/404
2013/0224988 A1 * 8/2013 Bishop ..... H01R 4/2433 439/389
2015/0288078 A1 * 10/2015 King, Jr. ..... H01R 4/2433 174/70 R
2015/0311607 A1 * 10/2015 Ding ..... H01R 4/22 439/402
2016/0218444 A1 * 7/2016 King, Jr. ..... H01R 13/533

* cited by examiner

WIRE CONNECTOR

CROSS-REFERENCE TO RELATED APPLICATIONS

The present application claims priority to and the benefit of Chinese Patent Application No. CN 201910365055.5 filed on Apr. 30, 2019, the entire content of which is incorporated herein by reference.

BACKGROUND OF THE INVENTION

1. Field of the Invention

The invention relates to the technical field of manufacturing illumination equipments, and more particularly, to a wire connector for an illumination equipment.

2. Description of the Related Art

With the popularity of illumination equipments, various types of illumination equipments are available now in the market. Different types of illumination equipments may have different modes of installation. Therefore, in most cases, a wire connector is used in the installation of the illumination equipment, such that the light equipment may be connected to the power supply in a more flexible way.

Of note, wires of the power supply of the existing wire connectors are prone to be exposed due to the structure thereof, so that leakage faults may occur. Therefore, the wire connector can be used for connection of low-voltage illumination equipments only. Moreover, the existing wire connectors have other disadvantages of complicated structure and higher production costs. Thus, now it is desired to have a wire connector which has a simpler structure and is safer to use.

SUMMARY OF THE INVENTION

Aiming at the above-mentioned problems in the prior art, the present invention provides a wire connector.

Detailed technical solution is as follows:

The invention comprises a wire connector, comprising:

a receiving part having a hollow structure, wherein input wires and output wires are arranged in the receiving part;

two conductive tabs, through which the input wires are connected to the output wires, the two conductive tabs are used to electrically connect the input wires and the output wires;

wherein the receiving part comprises at least one clamping groove;

a covering part clamped in the at least one clamping groove of the receiving part for sealing the two conductive tabs in the receiving part;

the receiving part is connected to the covering part by a flexible part.

Preferably, wherein the receiving part comprises a first horizontal portion and a second horizontal portion, two ends of a diagonal of the first horizontal portion are provided with a slot, respectively, and each of the two conductive tabs is arranged in each of the two slots, respectively.

Preferably, wherein the receiving part further comprises a first vertical portion and a second vertical portion, and an opening is formed between the first vertical portion and the second horizontal portion;

the covering part comprises a sealing strip that is clamped in the opening.

Preferably, wherein the covering part further comprises a clip, and the covering part is clamped in the clamping groove by the clip.

Preferably, wherein each of the two conductive tabs comprises two teeth which are oriented toward an interior of the receiving part and are perpendicular to the second horizontal portion.

Preferably, wherein the receiving part comprises:

a recess, disposed at an opening of the receiving part, the input wires being arranged in the recess; and two wire connecting holes in which the output wires are arranged respectively.

Preferably, wherein the receiving part comprises two slots, each of which is parallelly arranged in the receiving part, and the two conductive tabs are arranged in the two slots, respectively.

Preferably, wherein the opening of the receiving part is provided with the clamping groove at both sides;

the covering part is provided with a clip at both sides, and the covering part is clamped in the clamping groove by the clip.

Preferably, wherein one surface of the covering part that faces toward the recess is provided with a projection.

Preferably, wherein each of the two conductive tabs comprises two teeth which are arranged at the diagonal of the conductive tabs respectively, and each of the two teeth is connected to the input wires and the output wires, respectively.

By adopting the above-mentioned technical solutions, the present invention has the following beneficial effects: a wire connector having a full-covering structure, which is used to connect an output terminal of an external power supply to an input terminal of an illumination equipment, such that a more flexible installation of the illumination equipment may be ensured; in addition, security may be greatly improved since the wire connector is simple in structure.

BRIEF DESCRIPTION OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
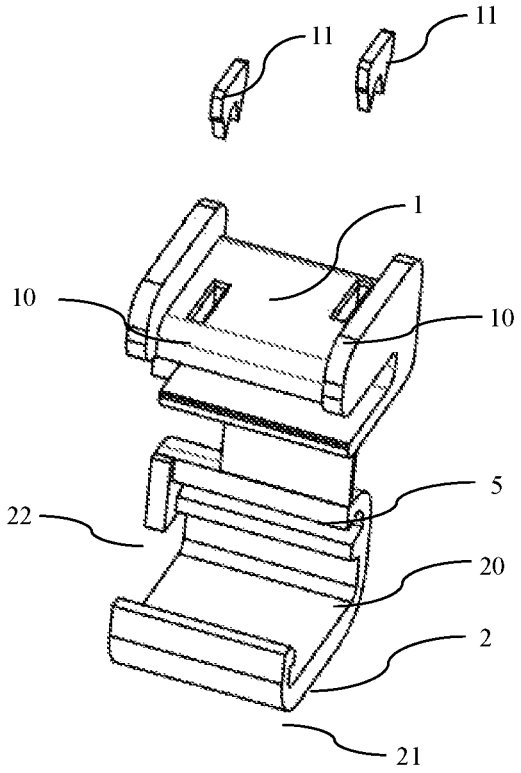
FIGS. 1 to 5 are schematic diagrams showing the structure of a first type of wire connector according to an embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, certain exemplary embodiments according to the present disclosure will be described with reference to the accompanying drawings.

Example 1

Figure 2:
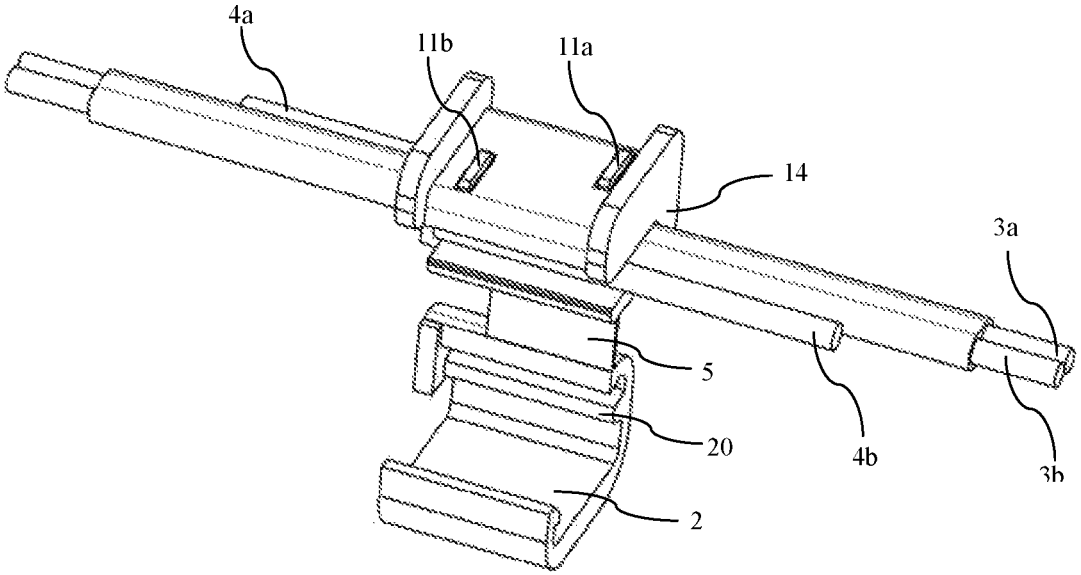

As shown in FIGS. 1 and 2, in a first embodiment of the present invention, a first type of wire connector is provided which comprises:

a receiving part 1 having a hollow structure, wherein input wires 3 (which comprises parts indicated at 3*a* and 3*b* as shown in FIG. 2) and output wires 4 (which comprises parts indicated at 4*a* and 4*b* as shown in FIG. 2) are arranged in the receiving part 1;

two conductive tabs 11, wherein the input wires 3 are connected to the output wires 4 by means of the two conductive tabs 11 (that is, parts indicated at 11*a* and 11*b* as shown in FIG. 2), the two conductive tabs 11 are used to electrically connect the input wires 3 and the output wires 4;

wherein the receiving part 1 comprises a clamping groove 13;

a covering part 2 clamped in the clamping groove 13 of the receiving part 1 for sealing the two conductive tabs 11 in the receiving part 1;

the receiving part 1 is connected to the covering part 2 by a flexible part 5.

Figure 4:
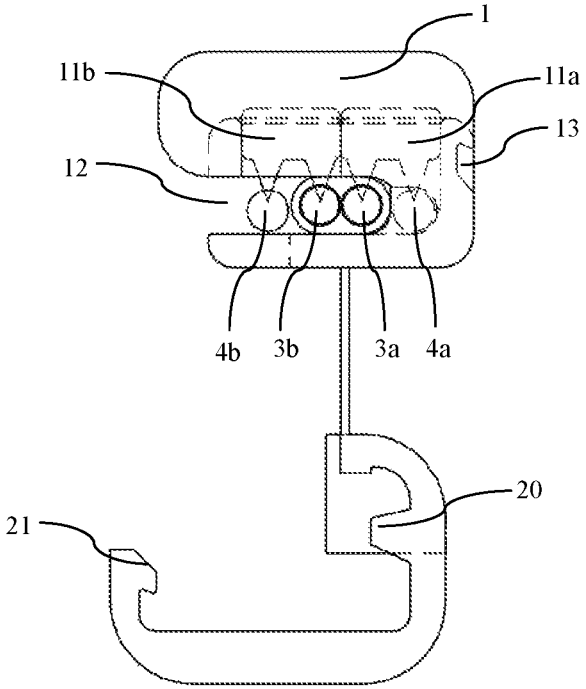

As shown in FIG. 4, the input wires comprise a first input wire 3*a* and a second input wire 3*b*, and the output wires comprise a first output wire 4*a* and a second output wire 4*b;* the first input wire 3*a* is connected to the first output wire 4*a* through the first conductive tab 11*a*; and the second input wire 3*b* is connected to the second output wire 4*b* through the second conductive tab 11*b*.

it should be noted that, for the purpose of illustration, the conductive tab for connecting the first input wire 3*a* to the first output wire 4*a* is defined as the first conductive tab 11*a*, and the conductive tab for connecting the second input wire 3*b* to the second output wire 4*b* is defined as the second conductive tab 11*b*; similarly, the slot for fixing the first conductive tab 11*a* is defined as a first slot 10*a*, and the slot for fixing the second conductive tab 11*b* is defined as a second slot 10*b*.

It can be known from the above-mentioned technical solution that the input wire of the wire connector is an output terminal of an external power supply, and the output wire of the wire connector is an input terminal of the illumination equipment according to an embodiment of the present invention, as shown in FIG. 2. The external power supply may be a DC power supply or an AC power supply for providing working voltage to the illumination equipment. The first input wire 3*a* and the second input wire 3*b* are a positive electrode and a negative electrode of the input terminal of the wire connector, respectively, and the first output wire 4*a* and the second output wire 4*b* are a positive electrode and a negative electrode of the output terminal of the wire connector. In this embodiment, the positive electrode of the input wire is connected to the positive electrode of the output wire by the first conductive tab 11*a*, and the negative electrode of the input wire is connected to the negative electrode of the output wire by the second conductive tab 11*b*.

Specifically, for ease of the installation of the wire connector, the receiving part 1 is connected with the covering part 2 by using the flexible part 5 prior to installation of the wire connector. Using of the wire connector comprises the steps of: first of all, passing the input wires and output wires through the receiving part 1; making the positive electrode of the input wires in contact with the positive electrode of the output wires, and making the negative electrode of the input wires in contact with the negative electrode of the output wires; inserting the two conductive tabs 11 into the two slots 10 of the receiving part 1 respectively; covering the two slots 10 with the slot of the covering part 1, such that two teeth of the first conductive tab 11*a* may pierce through the insulating layers of the first input wire 3*a* and the first output wire 4*a*, so that the first input wire 3*a* is electrically connected to the first output wire 4*a*; and two teeth of the second conductive tab 11*b* may pierce through the insulating layers of the second input wire 3*b* and the second output wire 4*b*, so that the second input wire 3*b* is electrically connected to the second output wire 4*b*. Furthermore, by adopting the above-mentioned technical solution, the output terminal of the external power supply is connected to the input terminal of the illumination equipment.

In a preferred embodiment, as show in FIG. 1, the receiving part 1 comprises a first horizontal portion and a second horizontal portion, two ends of a diagonal of the first horizontal portion are provided with an slot 10, respectively, and each of the two conductive tabs 11 is arranged in each of the two slots 10, respectively;

the receiving part 1 further comprises a first vertical portion and a second vertical portion, and an opening 12 is formed between the first vertical portion and the second horizontal portion;

a clamping groove 13 is formed in the second vertical portion;

the covering part 2 comprises a sealing strip 20 which is clamped in the opening 12;

the covering part 1 further comprises a clip 21, and the covering part 2 is clamped in the clamping groove 13 of the receiving part by the clip 21.

Specifically, in this embodiment, the first slot 10*a* and the second slot 10*b* are arranged at two ends of the diagonal of the first horizontal portion for avoiding short circuit, which results from the contact between the first conductive tab 11*a* and the second conductive tab 11*b*. Of note, such an arrangement is only a preferred embodiment of the present invention.

Specifically, the opening 12 is formed between the first vertical portion and the second horizontal portion. The input wires and the output wires may be disposed in the receiving part 1 through the opening 12. After positioned in corresponding locations, the input wires and the output wires are clamped in the opening by using the sealing strip 20 of the covering part 2, so as to achieve a sealing effect. The sealing strip 20 is fitted with the opening 12.

Specifically, as shown in FIG. 4, the covering part 2 further comprises a clip 21 in a shape of a hook, and the clip 21 is fitted with the clamping groove 13. The hook-shaped clip 21 may be better clamped in the clamping groove 13. As a result, the clip 21 may not loosen easily, and poor contact among the two conductive tabs, the input wires and the output wires may be avoided.

As a preferred embodiment, as shown in FIG. 4, each of the two conductive tabs 11 comprises two teeth which are oriented toward an interior of the receiving part 1 and are perpendicular to the second horizontal portion.

Specifically, in this embodiment, one end of each of the conductive tabs, which is oriented toward the interior of the receiving part 1, comprises two teeth. The two teeth are disposed on two sides of the end, respectively. The two conductive tabs are made of a metal material having a good electrical conductivity. The material of the conductive tabs here is copper.

Specifically, after the input wires and the output wires are installed in suitable positions of the receiving part 1, the first conductive tab 11*a* is inserted into the first slot 10*a*, and the second conductive tab 11*b* is inserted into the second slot 10*b*. The clip 21 of the covering part 2 is fixed in the clamping groove 13 of the receiving part 1. It should be mentioned that the covering part 2 covers on the first horizontal portion of the receiving part 1 and applies pressure to the two conductive tabs, such that the two teeth of the first conductive tab 11*a* may pierce through the insulating layers of the first input wire 3*a* and the first output wire 4*a*, and the two teeth of the second conductive tab 11*b* may pierce through the insulating layers of the second input wire 3*b* and the second output wire 4*b*. Therefore, the two teeth of the first conductive tab 11*a* are in contact with the conducting layers of the first input wire 3*a* and the first output wire 4*a*, respectively, and the two teeth of the second conductive tab 11*b* are in contact with the conducting layers of the second input wire 3*b* and the second output wire 4*b*, respectively.

Furthermore, by adopting the above-mentioned technical solution, the output terminal of the external power supply is connected to the input terminal of the illumination equipment and the illumination equipment is enabled to be in a conductive state. Wires for the output terminal of the external power supply may have a length according to the requirements, so as to improve the flexibility of the installation of the illumination equipment.

Figure 3:
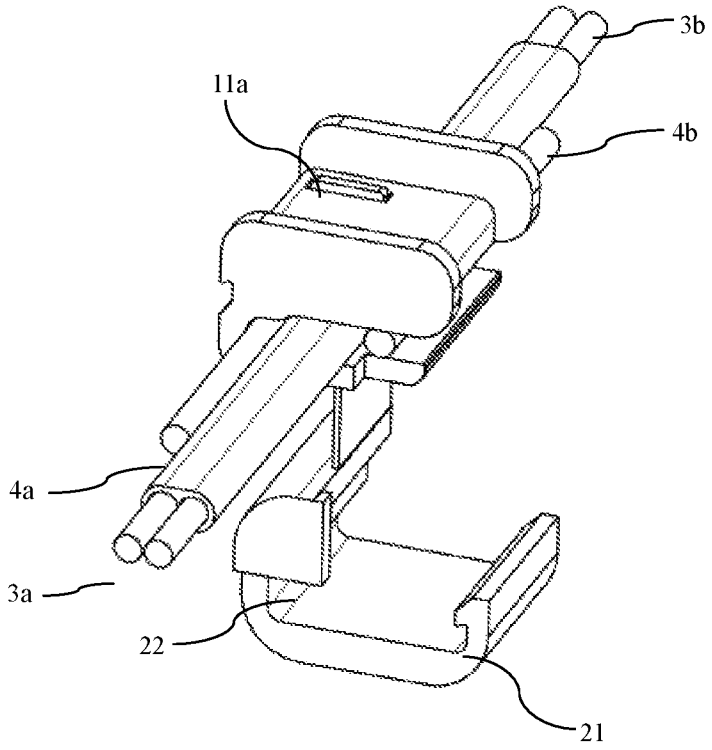
Figure 5:
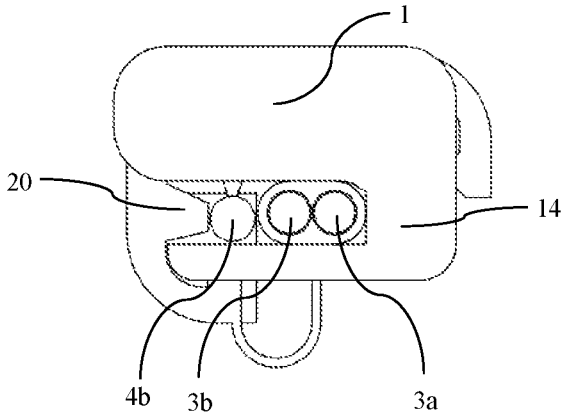

As a preferred embodiment, as shown in FIG. 5, the receiving part 1 further comprises a sealing plate 14 disposed between the first horizontal portion and the second horizontal portion;

as shown in FIG. 3, the covering part 2 further comprises a second sealing plate 23.

Specifically, with the fact that the openings of the first input wire 4*a* and the second output wire 4*b* of the wire connector may expose the conductive materials therein, it may pose a security risk due to the electrical leakage when in use of the wire connector. To solve the above-mentioned problem, one end of the first output wire 4*a*, to which the conductive material is exposed, is sealed in the receiving part 1 by using the first sealing plate 14, while the other end of the first output wire 4*a* is connected to the illumination equipment (not shown in the figures); furthermore, one end of the second output wire 4*b*, to which the conductive material is exposed, is sealed in the receiving part 1 by using the second sealing plate 23, while the other end of the second output wire 4*b* is connected to the illumination equipment (not shown in the figures).

Furthermore, FIG. 5 is a schematic diagram showing the structure of a wire connector after the assembly is completed. By adopting the above-mentioned technical solution, a full-covering structure of the wire connector is formed. In this way, parts of the input wires and the output wires, which expose the conductive layers, are covered up completely, such that electric shock accidents may be avoided when a user installs and uses the wire connector, and the security of the wire connector is improved.

Example 2

Figure 6:
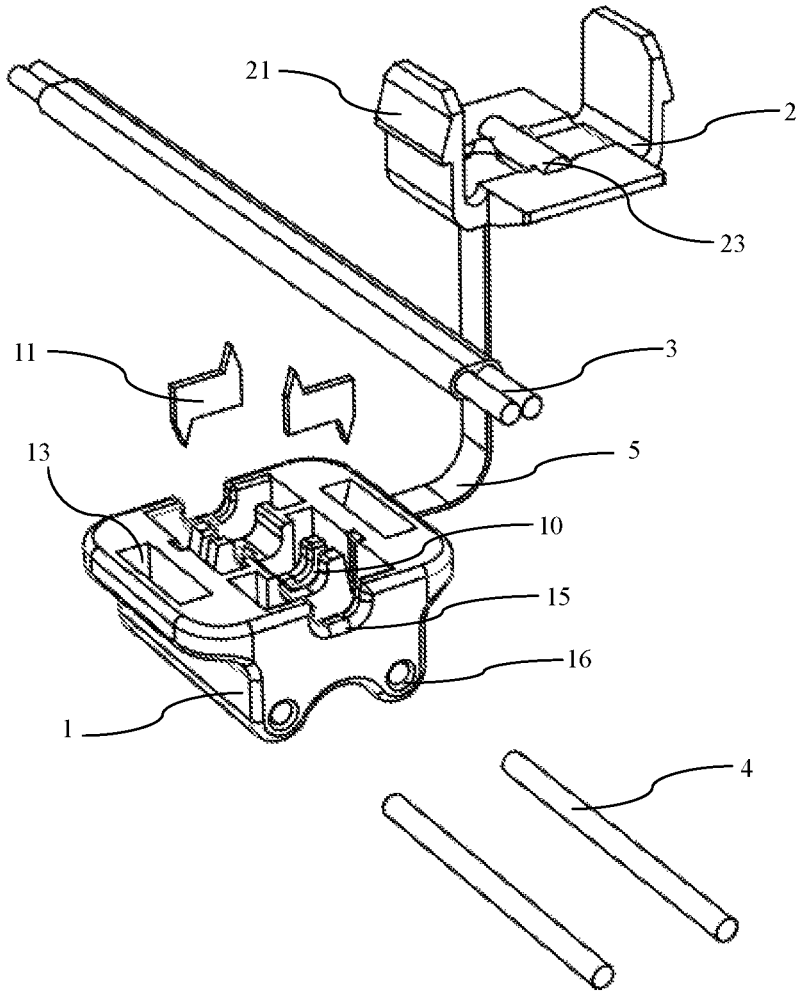
FIGS. 6 to 10 are schematic diagrams showing the structure of a second type of wire connector according to an embodiment of the present invention.

As shown in FIG. 6, in a second embodiment of the present invention, a second type of wire connector is provided which comprises:

a receiving part 1 having a hollow structure, wherein input wires 3 and output wires 4 are arranged in the receiving part 1;

two conductive tabs 11, wherein the input wires 3 are connected to the output wires 4 by means of the two conductive tabs 11, the two conductive tabs 11 are used to electrically connect the input wires 3 and the output wires 4;

wherein the receiving part 1 comprises two clamping grooves 13;

a covering part 2 clamped in the two clamping grooves 13 of the receiving part 1 for sealing the two conductive tabs 11 in the receiving part 1;

the receiving part 1 is connected to the covering part 2 by a flexible part 5.

Figure 7:
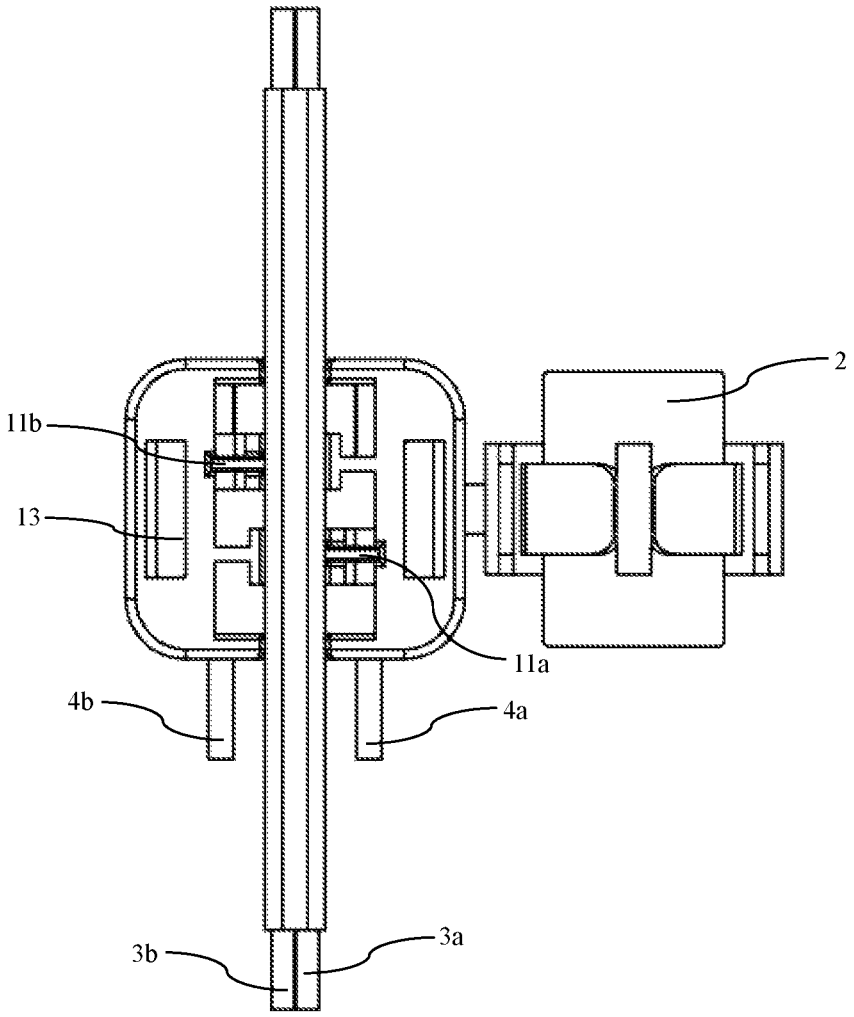

As shown in FIG. 7, the input wires 3 comprise a first input wire 3*a* and a second input wire 3*b*, and the output wires 4 comprise a first output wire 4*a* and a second output wire 4*b;* the first input wire 3*a* is connected to the first output wire 4*a* by the first conductive tab 11*a*; and the second input wire 3*b* is connected to the second output wire 4*b* by the second conductive tab 11*b;* a recess 15, disposed at an opening of the receiving part 1, the input wires 3 being arranged in the recess 15; and two wire connecting holes 16 in which the output wires 4 are arranged respectively.

In the embodiment of the present invention, the input wires of the second type of wire connector is connected to an output terminal of an external power supply, and the output wires of the wire connector is connected to an input terminal of the illumination equipment. The external power supply may be a DC power supply or an AC power supply for providing working voltage to the illumination equipment.

Specifically, the second type of wire connector provided in this embodiment is used to connect the input wires and the output wires, and to electrically connect the input wires and the output wires. As shown in FIG. 7, both the input wires 3 and the output wires 4 comprise positive electrodes and negative electrodes. For the purpose of simple illustration, in this embodiment, the positive electrode of the input wires is defined as the first input wire 3*a*, the negative electrode of the input wires is defined as the second input wire 3*b*; the positive electrode of the output wire 4 is defined as the first output wire 4*a*, and the negative wire of the output wire is defined as the second output wire 4*b*.

Figure 9:
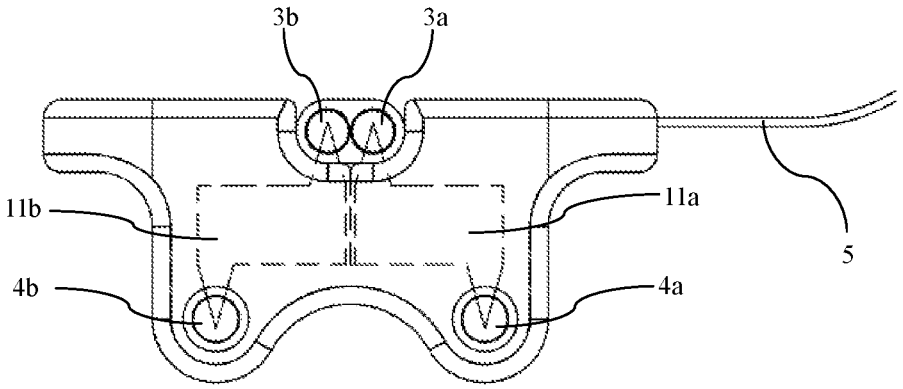

Specifically, FIG. 9 is a perspective view of an internal structure of a receiving part 1. The receiving part 1 comprises an open end and a closed end. The recess is disposed at the open end of the receiving part 1. The wire connecting holes are formed in the closed end of the receiving part 1 respectively. The first input wire 3*a* and the second input wire 3*b* are disposed in the recess, and the first output wire 4*a* and the second output wire 4*b* are disposed in the wire connecting holes, respectively. The first input wire 3*a* is connected to the first output wire 4*a* by the first conductive tab 11*a*, and the second input wire 3*b* is connected to the second output wire 4*b* by the second conductive tab 11*b*.

In a preferred embodiment, as show in FIG. 6, the receiving part 1 comprises two slots 10, each of the two slots 10 is parallelly arranged in the receiving part 1, and the two conductive tabs 11 are arranged in the two slots 10, respectively.

Specifically, the two slots 10 are arranged at two sides of the receiving part 1, respectively, such that the first conductive tab 11*a* is located a distance away from the second conductive tab 11*b*, and short circuit, due to the contact between the first conductive tab 11*a* and the second conductive tab 11*b*, may be avoided.

In a preferred embodiment, as shown in FIG. 6, the receiving part 1 comprises:

Two slots 13, provided on two sides of the open end of the receiving part 1;

the covering part 2 is provided with a clip 21 at both sides, and the covering part 2 is clamped in the clamping groove 13 by the two clips 21;

one surface of the covering part 2 that faces toward the recess 15 is provided with a projection 22.

Specifically, by adopting the above-mentioned technical solution, the two clips 21 of the covering part 2 are clamped in the clamping grooves 13, so that the covering part 2 covers the open end of the receiving part 1, so as to make the conductive parts of the input wires and the output wires be sealed inside the receiving part 1. The receiving part 1 is made of insulating material, so that electric shock accidents may be avoided when a user installs and uses the wire connector, and the security of the second type of wire connector is improved.

Specifically, the projection 22 is provided on the covering part 2. The projection 22 is fitted with the recess 15. The projection 22 is used to apply pressure to the input wires 3, so that the teeth of the first conductive tab 11 pierce through the insulating layers of the input wires and the insulating layers of the output wires, and are in contact with conductive materials of the input wires and the output wires. The conductive tabs 11 are made of a metal material. The material of the conductive tabs 11 here is copper.

Preferably, the clip 21 of the covering part 2 is fitted with the clamping groove 13 of the receiving part 1. Such a structure allows the covering part 2 to be better fixed at the open end of the receiving part 1, and the covering part 2 may not loosen easily, and poor contact among the conductive tabs 11, the input wires 3 and the output wires 4 may be avoided.

In a preferred embodiment, each of the two conductive tabs 11 comprises two teeth which are arranged at the diagonal of the conductive tab 11. The two teeth are connected to the input wires 3 and the output wires 4, respectively.

Figure 8:
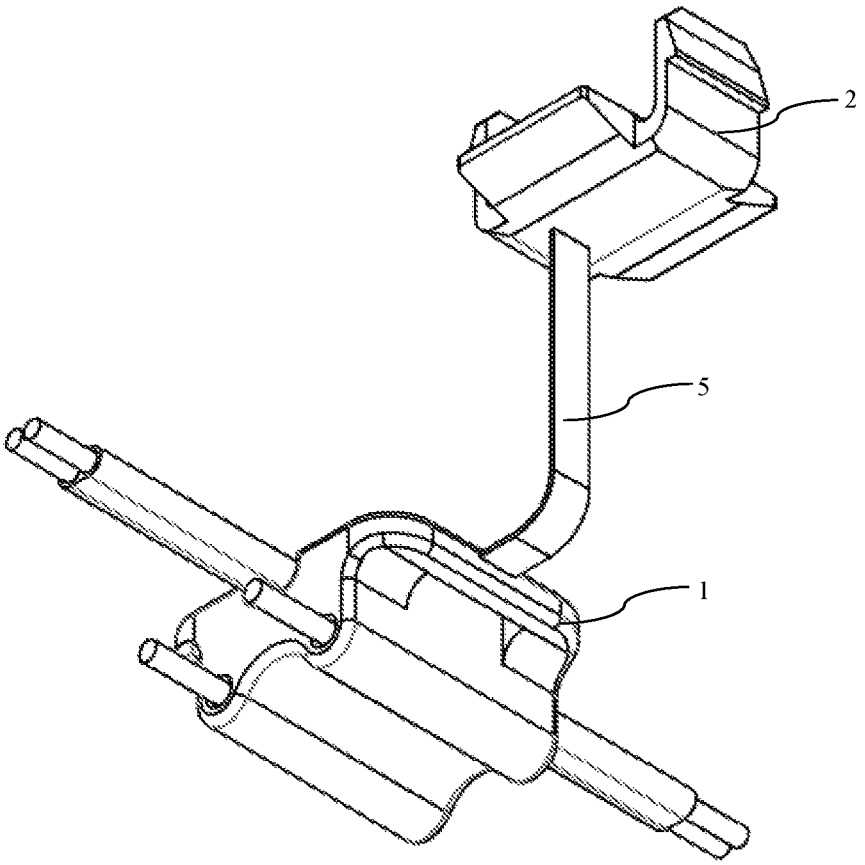

Specifically, using of the second type of wire connector comprises the steps of: first of all, the first input wire 3*a* and the second input wire 3*b* are disposed in the recess 15 of the receiving part 1, then the first output wire 4*a* and the second output wire 4*b* are disposed in the two wire connecting holes, respectively. Then the two clips 21 of the covering part 2 are pressed into the recess 13, such that the covering part 2 is fixed on the receiving part 1 and covers the open end of the receiving part 1. As shown in FIG. 8, for ease of the installation of the second type of wire connector, the receiving part 1 is connected with the covering part 2 by using the flexible part 5.

Figure 10:
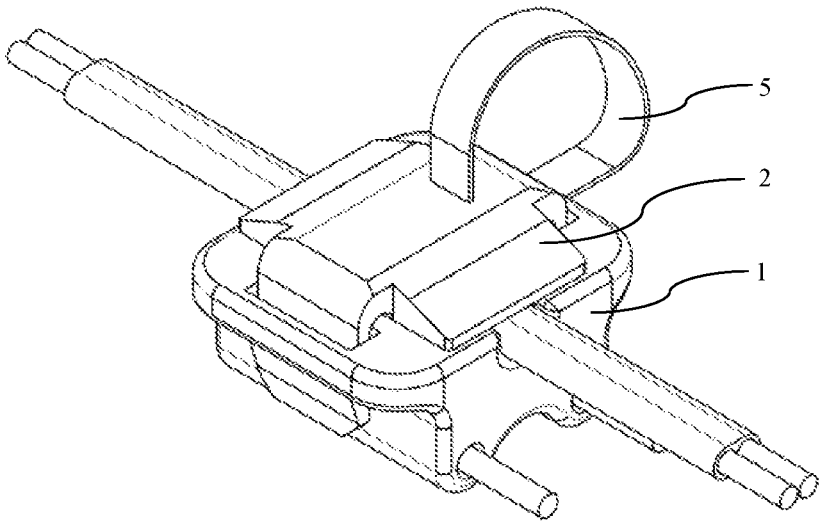

Preferably, the two teeth of the first conductive tab 11*a* pierce through the insulating layers of the first input wire 3*a* and the first output wire 4*a*, so as to electrically connect the first input wire 3*a* and the first output wire 4*a*; and two teeth of the second conductive tab 11*b* may pierce through the insulating layers of the second input wire 3*b* and the second output wire 4*b*, so as to electrically connect the second input wire 3*b* and the second output wire 4*b*. Furthermore, by adopting the above-mentioned technical solution, the output terminal of the external power supply is connected to the input terminal of the illumination equipment. FIG. 10 is a schematic diagram showing the structure of the second type of wire connector after the assembly is completed. In this figure, the covering part 2 completely covers the open end of the receiving part 1, and both the receiving part 1 and the covering part 2 are made of insulating material, such that electrical leakage of the conductive tabs may be avoided.

By adopting the above-mentioned technical solutions, the present invention has the following beneficial effects: a wire connector having a full-covering structure, which is used to connect an output terminal of an external power supply to an input terminal of an illumination equipment, such that a more flexible installation of the illumination equipment may be ensured; in addition, security may be greatly improved since the wire connector is simple in structure.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A wire connector, comprising:

a receiving part having a hollow structure, wherein input wires and output wires are arranged in the receiving part;

two conductive tabs, through which the input wires are connected to the output wires, the two conductive tabs are used to electrically connect the input wires and the output wires;

wherein the receiving part comprises at least one clamping groove;

a covering part clamped in the at least one clamping groove of the receiving part for sealing the two conductive tabs in the receiving part;

the receiving part is connected to the covering part by a flexible part;

the input wires comprise a first input wire and a second input wire, and the output wires comprise a first output wire and a second output wire;

the first input wire is connected to the first output wire through a first conductive tab; and the second input wire is connected to the second output wire through a second conductive tab; the two conductive tabs comprises the first conductive tab and the second conductive tab;

the first input wire and the second input wire are a positive electrode and a negative electrode of input terminal of the wire connector, and the first output wire and the second output wire are a positive electrode and a negative electrode of output terminal of the wire connector.

2. The wire connector of claim 1, wherein the receiving part comprises a first horizontal portion and a second horizontal portion, two ends of a diagonal of the first horizontal portion are provided with a slot, respectively, and each of the two conductive tabs is arranged in each of the two slots, respectively.

3. The wire connector of claim 2, wherein the receiving part further comprises a first vertical portion and a second vertical portion, and an opening is formed between the first vertical portion and the second horizontal portion;

the covering part comprises a sealing strip that is clamped in the opening.

4. The wire connector of claim 1, wherein the covering part further comprises a clip, and the covering part is clamped in the clamping groove of the receiving part by the clip.

5. The wire connector of claim 2, wherein each of the two conductive tabs comprises two teeth which are oriented toward an interior of the receiving part and are perpendicular to the second horizontal portion.

6. The wire connector of claim 1, wherein the receiving part comprises:

a recess, disposed at an opening of the receiving part, the input wires being arranged in the recess; and two wire connecting holes in which the output wires are arranged respectively.

7. The wire connector of claim 1, wherein the receiving part comprises two slots, each of which is parallelly arranged in the receiving part, and the two conductive tabs are arranged in the two slots, respectively.

8. The wire connector of claim 1, wherein the opening of the receiving part is provided with the clamping groove at both sides;

the covering part is provided with a clip at both sides, and the covering part is clamped in the clamping groove by the clip.

9. The wire connector of claim 6, wherein one surface of the covering part that faces toward the recess is provided with a projection.

10. The wire connector of claim 1, wherein each of the two conductive tabs comprises two teeth which are arranged at the diagonal of the conductive tabs respectively, and each of the two teeth is connected to the input wires and the output wires, respectively.

* * * * *